US005740714A

United States Patent [19]

Martin

[11] Patent Number: 5,740,714

[45] Date of Patent: Apr. 21, 1998

[54] ROTARY BLADE CLAMPING ASSEMBLY

[76] Inventor: Mark S. Martin, 13760 Walton-Verona Rd., Verona, Ky. 41092

[21] Appl. No.: 755,651

[22] Filed: Nov. 25, 1996

Related U.S. Application Data

[63] Continuation of Ser. No. 328,446, Oct. 25, 1994, abandoned.

[51] Int. Cl.[6] ..... B26D 1/62

[52] U.S. Cl. ..... 83/698.31; 83/346; 83/674; 83/677; 83/698.61; 493/471

[58] Field of Search ..... 83/331, 343, 346, 83/347, 663, 669, 670, 674, 677, 698.31, 698.41, 698.42, 698.51, 698.61; 493/468, 471

[56] References Cited

U.S. PATENT DOCUMENTS

| | | | |
|---|---|---|---|
| 634,255 | 10/1899 | Annand | 83/331 |
| 2,682,306 | 6/1954 | Schriber . | |
| 3,251,256 | 5/1966 | McGrath | 83/677 X |
| 3,277,756 | 10/1966 | Des Jardins et al. . | |
| 3,527,123 | 9/1970 | Dovey . | |
| 3,709,077 | 1/1973 | Trogen et al. . | |
| 4,131,047 | 12/1978 | Schriber et al. . | |
| 4,412,467 | 11/1983 | DeSanto . | |
| 4,475,425 | 10/1984 | Punater et al. . | |
| 4,640,165 | 2/1987 | McMahon et al. . | |
| 4,848,202 | 7/1989 | Crampton . | |
| 4,920,843 | 5/1990 | Stromberg et al. . | |
| 5,086,683 | 2/1992 | Steidinger | 83/346 X |
| 5,211,096 | 5/1993 | Steidinger | 83/698.61 X |
| 5,224,408 | 7/1993 | Steidinger | 83/346 X |
| 5,282,409 | 2/1994 | Rojas | 83/698.51 X |

*Primary Examiner*—Rinaldi I. Rada
*Assistant Examiner*—Clark F. Dexter
*Attorney, Agent, or Firm*—Charles R. Wilson

[57] ABSTRACT

A blade clamping assembly for use with a rotary cylinder is designed to allow a quick change of a perforating blade, cutting blade or scoring blade. The assembly comprises an elongated retainer bar, an elongated backing plate and at least one compressive spacer. The inside faces of the retainer bar and the backing plate have a set of aligned cavities to hold the compressive spacers in place. The retainer bar preferably has a lower support ledge along an outside face to hold the blade and also has set screws with associated lock caps and resilient pegs to adjust the blade's height. Adjustment of the set screws allows a precise setting of the assembly and associated blade in a groove of the rotary cylinder. When the assembly is positioned in the cylinder's groove, the compressive spacers clamp the blade against a side wall of the groove. The blade is readily changed by forcing the retainer bar against the backing plate to compress the compressive spacers, thereby freeing the blade. The blade is quickly replaced with a new blade and the force removed to again clamp the associated blade against the groove's side wall.

21 Claims, 3 Drawing Sheets

ROTARY BLADE CLAMPING ASSEMBLY

This application is a continuation of application Ser. No. 08/328,446, filed Oct. 25, 1994, now abandoned.

This invention relates to a blade clamping assembly. More particularly, the invention relates to a rotary blade clamping assembly with a blade quick release feature.

BACKGROUND OF THE INVENTION

The printing and collating industries make extensive use of rotary cylinders for conveying continuous webs of paper, cloth, plastic and other thin sheet materials at a high rate of speed. In one phase of the operation, a rotary cylinder and a back-up or counter pressure cylinder are used to impart a set of perforations across the web, to sever the web into several individual pieces of precise length or to score the web for folding purposes. The rotary cylinder is constructed with one or more transverse grooves in its surface. The grooves hold an elongated blade in a manner whereby only an edge of the blade extends above the surface of the rotary cylinder. The nature of the operation dictates the type of blade that must be used. There are blades available with a toothed edge for perforating, a sharp edge for cutting and a blunt edge for scoring.

The rotary and back-up cylinders are positioned juxtaposed with a clearance sufficient to allow the web to pass through. The blade in the rotary cylinder contacts the web at the point where the web travels between the two cylinders. The clearance between the two cylinders is adjusted so that sufficient pressure is present to cause the teeth of a perforating blade to punch a set of transverse holes into the web at a plurality of locations along its length. The number of holes is dependent on the perforating blade used. A cutting blade, of course, severs the web to create separate pieces. The scoring blade creates a transverse fold line which helps in a subsequent folding operation.

Each blade must be precisely set in the groove of the rotary cylinder to get a clean cut. Necessarily, the teeth or cutting edge on a blade eventually wears down. A new blade must be inserted at that time. As can be imagined, continuous webs travel very fast through the printing or collating machines for cost saving reasons. Any time needed to change a blade reduces the machine's efficiency. The machine must be stopped, the old blade removed, a new blade properly installed and any needed calibration completed. Ideally, all the aforementioned steps are completed in seconds.

The excessive down-time needed to change a blade in a printing or collating operation is recognized. Others have attempted to reduce the time by making improved blade assemblies or systems with various blade change-over time saving features. For example, U.S. Pat. Nos. 4,475,425 and 4,848,202 disclose systems which are said to satisfactorily address the problem. However, one or more drawbacks are associated with the disclosed systems. The system of U.S. Pat. No. 4,475,425 requires a side bolt assembly to properly hold the blade in the cylinder's groove. This necessarily takes time to disassemble and reassemble. U.S. Pat. No. 4,848,202 discloses a mechanism which appears to provide a true quick release feature. However, no means is provided for blade height adjusting purposes and for this reason alone the disclosed assembly is less than fully satisfactory.

In accord with a long felt need, there has now been developed a blade clamping assembly for use in a rotary cylinder which provides a blade quick release feature and provides a blade height adjusting feature for precision perforating, cutting and scoring. The assembly is adapted for use with several blades having varying thickness and for use in several rotary cylinders of different structural dimensions. The blade clamping assembly of the invention provides an efficient and effective solution to a problem known by many but to date not fully satisfactorily solved.

SUMMARY OF THE INVENTION

A blade clamping assembly is for use with a rotary cylinder adapted to hold a perforating blade, cutting blade or scoring blade. The assembly comprises an elongated retainer bar, an elongated backing plate and at least one resilient compressive spacer disposed between the retainer bar and backing plate. The whole assembly is dimensioned to fit within a groove on the rotary cylinder. It exerts a clamping force against the blade and a side wall of the groove. The assembly is structured to facilitate a quick replacement of the blade and also to adjust the blade's height in the groove.

The elongated retainer bar of the blade clamping assembly has a support ledge extending from a lower edge of an outside face to provide a surface for the blade to rest. An inside face of the retainer bar and an inside face of the backing plate each have at least one aligned positioning cavity. The compressive spacers are disposed in the aligned cavities. When the blade clamping assembly and a blade are inserted into the groove of the rotary cylinder, the compressive spacers force apart the retainer bar with its blade and the backing plate sufficiently to create a secure friction-fit of the blade in the groove. Height adjusting means are a part of the retainer bar. The assembly also has means whereby the compressive spacers are capable of being compressed together sufficiently to free the blade and allow its ready removal from the blade clamping assembly and the rotary cylinder groove. A new blade is as readily installed.

DETAILED DESCRIPTION OF THE INVENTION

The blade clamping assembly of the invention is described in the following paragraphs in detail and with reference to the drawings. The assembly finds its most use with perforating blades and for this reason the description and drawings are directed to the perforating blade. The blade clamping assembly can as well be used to hold blades such as cutting blades and scoring blades in a rotary cylinder.

All manner of continuous webs are treated in accord with the invention. Paper, cloth and plastic webs are examples of continuous webs which are commonplace and whose treatment in the commercial plant utilize the blade clamp assembly of the invention. Other thin continuous webs can be treated. The components of the blade clamping assembly and its manner of use are described below.

Figure 1:
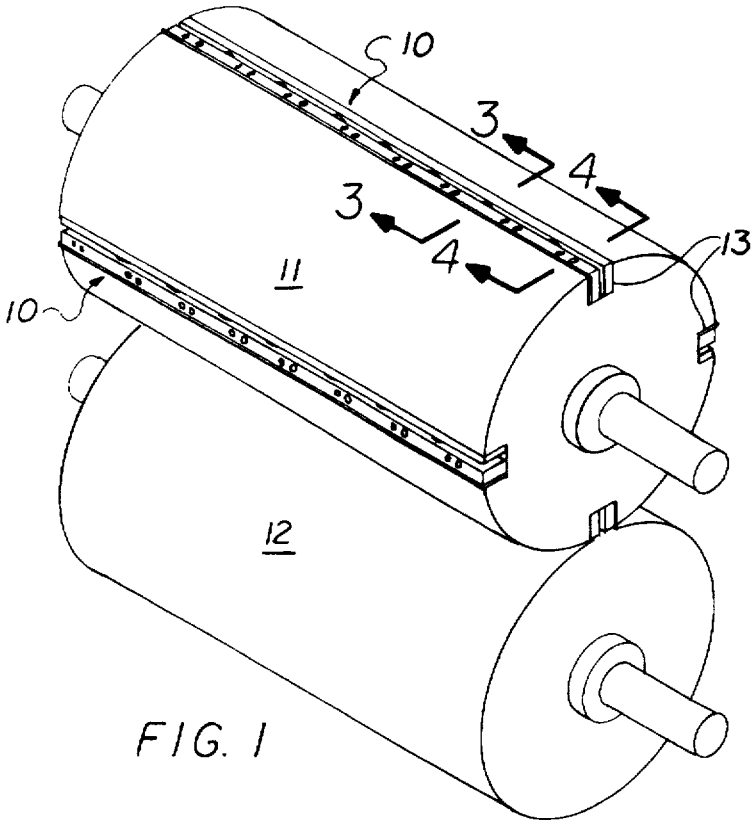
FIG. 1 is an environmental view of the blade clamping assembly of the invention positioned in a rotary cylinder.

With reference to FIG. 1, the blade clamping assembly 10 is shown in position in a rotary cylinder 11. The rotary cylinder 11 and a back-up cylinder 12 are conventional and are widely used in the printing and collating industry. As shown, there are four transverse peripheral grooves 13 uniformly spaced in the rotary cylinder surface. Each groove has a rectangularly-shaped cross-section and has an open top. A bottom wall 14 is substantially flat and each side wall 15 and 16 extends substantially perpendicularly therefrom. A single groove on a rotary cylinder is possible as well as multiple grooves on a rotary cylinder. Commonly, a rotary cylinder has from three to twelve transverse peripheral grooves uniformly spaced in its surface. Each groove normally has a width which ranges from about one-half inch to about one inch and a depth which ranges from about three-fourths inch to about one and one-fourth inches.

A perforating blade 17 is positioned in each groove 13 so that teeth found on one edge extend above the surface of the rotary cylinder. The blade 17 is commercially available. It has a length approximate that of the groove in the rotary cylinder and a height approximate that of the groove's depth. A wide range of blade teeth number, teeth shape and teeth spacing are available on various blades depending on the job specifications.

Figure 2:
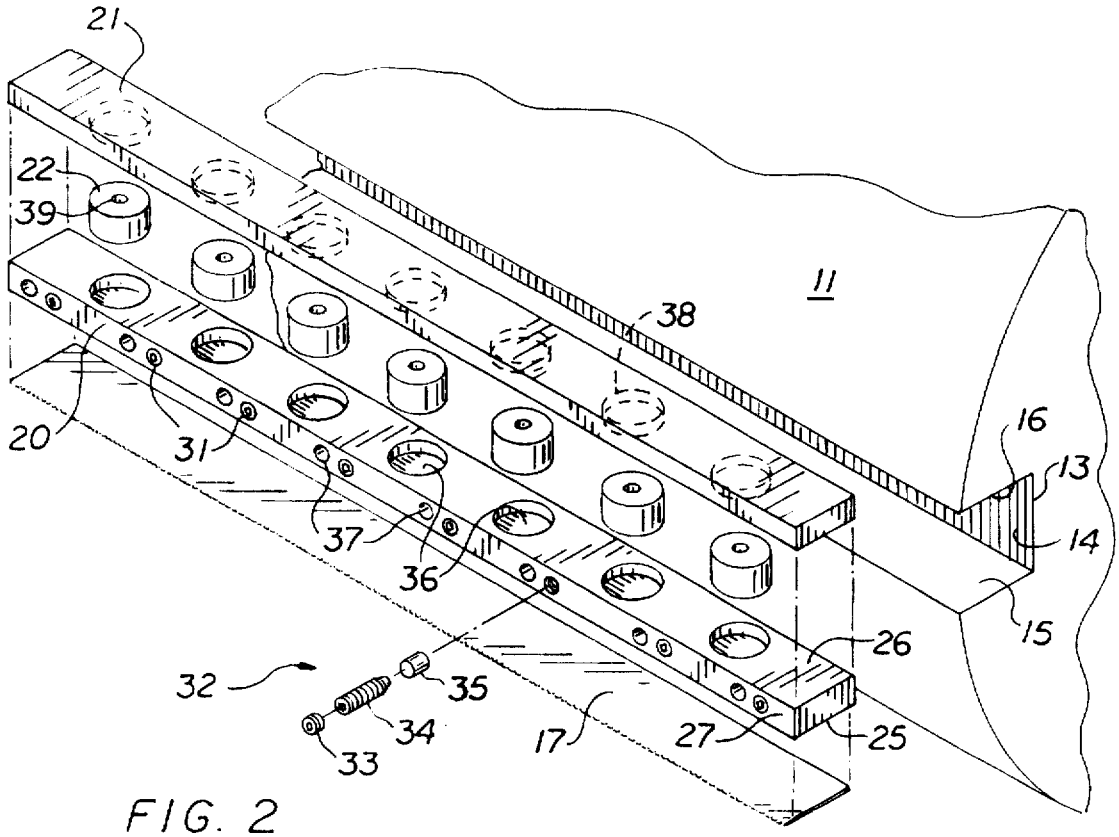
FIG. 2 is an exploded view in perspective of the blade clamping assembly and rotary cylinder of FIG. 1.
Figure 3:
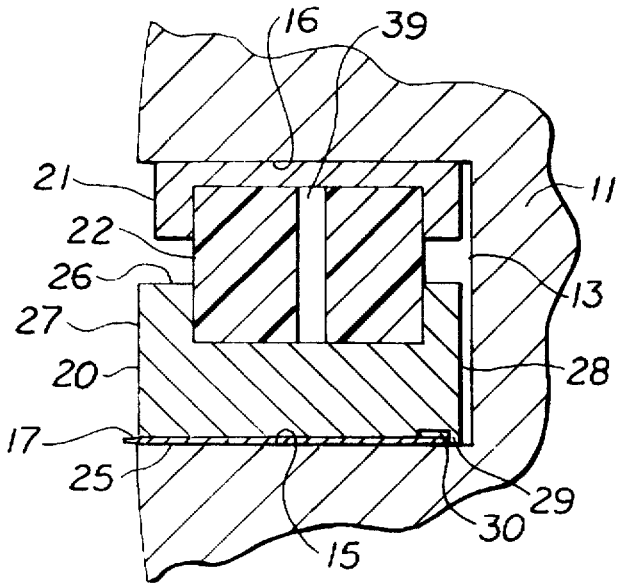
FIG. 3 is a partial end view in section of the blade clamping assembly and rotary cylinder of FIG. 1 taken along line 3—3 thereof.
Figure 4:
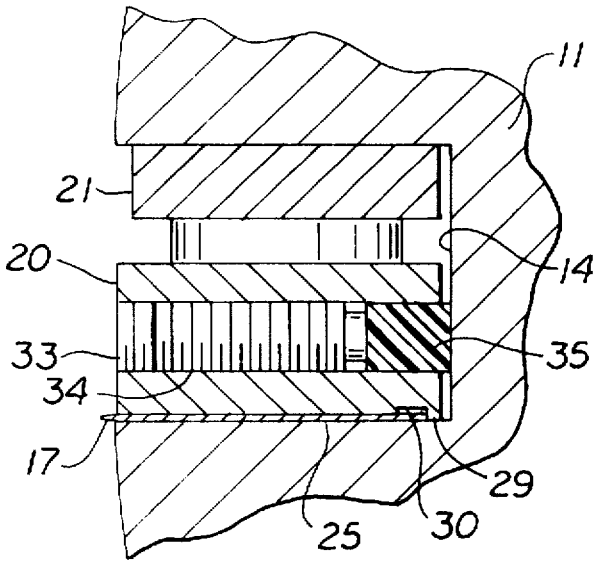
FIG. 4 is a partial end view in section of the blade clamping assembly and rotary cylinder of FIG. 1 taken along line 4—4 thereof.

In accord with the invention and with reference to FIGS. 2–4, the blade clamping assembly 10 has as its essential components an elongated retainer bar 20, an elongated backing plate 21 and a set of compressive spacers 22. When properly positioned in a groove 13 of the rotary cylinder 11, the blade clamping assembly 10 securely holds the perforating blade 17 in the groove 13 such that a cutting portion extends above the cylinder's surface.

The elongated retainer bar 20 of the blade clamping assembly 10 has a length approximate that of the groove in the rotary cylinder where it is to be used. The retainer bar 20 is a rigid rectangular-shaped bar with an outside face 25, an inside face 26, a top face 27 and a bottom face 28. As best seen in FIGS. 3 and 4, the outside face 25 has a support ledge 29 which extends from its lower edge. The perforating blade 17 rests on the ledge 29 in operation. A recess 30 extending across the outside face 25 of the retainer bar 20 is preferably near the lower edge to aid in releasing the perforating blade during a blade change-over.

Height adjusting means are included in the retainer bar to adjust its height in the groove and the consequent distance the teeth of the associated perforating blade extend above the rotary cylinder's surface. With reference to FIGS. 2 and 4, substantially uniformly spaced threaded holes 31 are drilled into the top face 27 of the retainer bar 20 and extend through the bottom face 28 of the retainer bar. The holes are internally threaded and are used to receive set screw assemblies 32. Each set screw assembly 32 includes a lock cap 33, a threaded screw shaft 34 and a resilient peg 35. The lock cap 33 is threaded and has a recess to receive a head of a wrench. The peg 35 is cylindrical-shaped and made of a hard resilient material. An acetal resin commercially available as DELRIN is preferred. The resiliency of the peg is responsible for the assembly having a tolerance for a certain degree of blade edge irregularity. In effect, the pegs allow the blade to float so as to accommodate blade height variance. The pegs also act as a shock absorber for the blade edge and tend to lengthen the useful life of the blade. Pegs made from a polyurethane having a Shore D hardness of from 40 to 50, phenolic resin, or still other materials which have a limited resiliency to allow a minimal compression in response to pressure experienced in operation and a return to original dimensions once the pressure is removed can be used.

A set screw assembly 32 is used in each of the internally threaded holes 31 extending through the retainer bar 20. As evident in FIG. 4, the resilient peg 35 extends partially out of the hole and makes contact with the bottom wall 14 of the groove 13. Each set screw assembly is individually adjusted so that its resilient peg contacts the groove's bottom wall and causes the perforating blade teeth to extend above the rotary cylinder's surface an equal distance across the cylinder.

With reference to FIG. 2, a set of substantially uniformly spaced positioning cavities 36 are drilled into the inside face 26 of the retainer bar 20 for the purpose of seating the compressive spacers 22. Three to twenty-five cavities are possible, though, preferably from three to ten cavities are used. Each cavity 36 is cylindrical-shape with a diameter slightly larger than the diameter of the compressive spacers. The cavities are centered in the inside face of the retainer bar with about one inch to three inches on-center lateral spacings. The size and shape of the cavities are coordinated with the size and shape of the compressive spacers. Cavities which are rectangular, square, triangular, oval or any other shape can as well be used. A single cavity to hold a compressive spacer strip is also feasible. Preferably, however, and as shown, the cavities are circular for reasons explained below with respect to a discussion of the compressive spacers.

A second set of spaced holes 37 in the top face 27 of the retainer bar 20 extend at least partially into the bar. The holes are used to receive prongs of a tool described with reference to FIG. 5. The hole spacings are adjusted to match the prong spacings. Each hole 37 can extend all the way through the retainer bar 20, though preferably for manufacturing and strength reasons extend approximately mid-way into the bar 20.

The blade clamping assembly 10 also includes an elongated backing plate 21. The backing plate has a width and height approximate that of the elongated retainer bar 20. Its purpose is to help retain the compressive spacers properly positioned during a perforating operation. A set of spaced positioning cavities 38 are drilled into an inside face of the plate 21. The cavities are spaced to be in alignment with the spaced positioning cavities 36 of the retainer bar 20. Their size and shape are also dependent on the compressive spacers.

The compressive spacers 22 are disposed in the aligned positioning cavities of the retainer bar 20 and the backing plate 21. The compressive spacers 22 are cylindrical-shaped to fit the sets of positioning cavities and have a length sufficient to get the needed friction-fit, e.g. about one-fourth inch to about three-fourths inch. Preferably, a hole 39 extends axially through the center of each of the compressive spacers. The hole 39 in each of the compressive spacers allows the spacer to expand radially substantially equally in all directions.

Each compressive spacer 22 is made of a resilient material. Polyurethane is preferred, though other elastomeric materials such as polyester and polyether can be used. In use, the compressive spacers force apart the retainer bar and the backing plate sufficiently to create a friction-fit of the perforating blade 17 in the transverse peripheral groove 13 of the rotary cylinder 11. The nature of the compressive spacers is such that a wider range of tolerance for groove width, blade thickness, and retainer bar width variances is possible. Regardless of any variance, the compressive spacers exert a constant pressure clamping action on the blade.

As evident in FIGS. 3 and 4, the blade clamping assembly 10 and the perforating blade 17 properly positioned on the support ledge of the retainer bar are held in the groove 13 of the cylinder 11 by friction. The compressive spacers 22 exert axial forces which forces the backing plate 21 against one side wall 16 of the groove and forces the retainer bar 20 and associated perforating blade 17 against an opposite side wall 15 of the groove. The forces separating the backing plate 16 and the retainer bar 20 are exerted orthogonally. The perforating blade is effectively clamped into the groove with sufficient force that the enormous centrifugal forces experienced by the high speed rotation of the rotary cylinder do not dislodge the blade from the groove.

The distance that teeth of the perforating blade extend above the surface of the rotary cylinder is adjusted by the height adjusting means of the blade clamping assembly. Accurate seating of the blade and teeth extension above the cylinder's surface is needed to prevent uneven perforations in the web. Any unevenness in the perforations results in a variation in tear strength along the perforated area which can result in web jamming at the plant and does result in consumer dissatisfaction. Still with reference to FIG. 4, each of the set screw assemblies 32 is threaded through the holes 31 in the retainer bar 20 until the resilient pegs 35 contact the bottom wall 14 of the groove. Continued threading causes the retainer bar to rise in the groove. Necessarily, the perforating blade and the balance of the assembly is also forced to rise with the retainer bar. When the assembly is first used, each of the set screw assemblies needs to be carefully adjusted so that height uniformity across the blade is achieved.

In operation, the blade clamping assembly of the invention is initially forced into a groove of the rotary cylinder. Preferably, one end of the assembly is compressed by hand and inserted into the groove at an about 45 degree angle. The balance of the assembly is pushed partially into the groove and then, with the use of a soft-head hammer, forced fully into the groove. Preferably also, a quick set adhesive is applied to the threads of the set screws. The set screws with associated pegs are promptly threaded into the retainer bar of the assembly and adjusted to the desired height so that all the set screws are seated and the load distributed substantially evenly along the retainer bar. Installation of the lock caps into the threaded holes until each one engages a set screw is next completed to help retain the proper position of the set screws and pegs.

Figure 5:
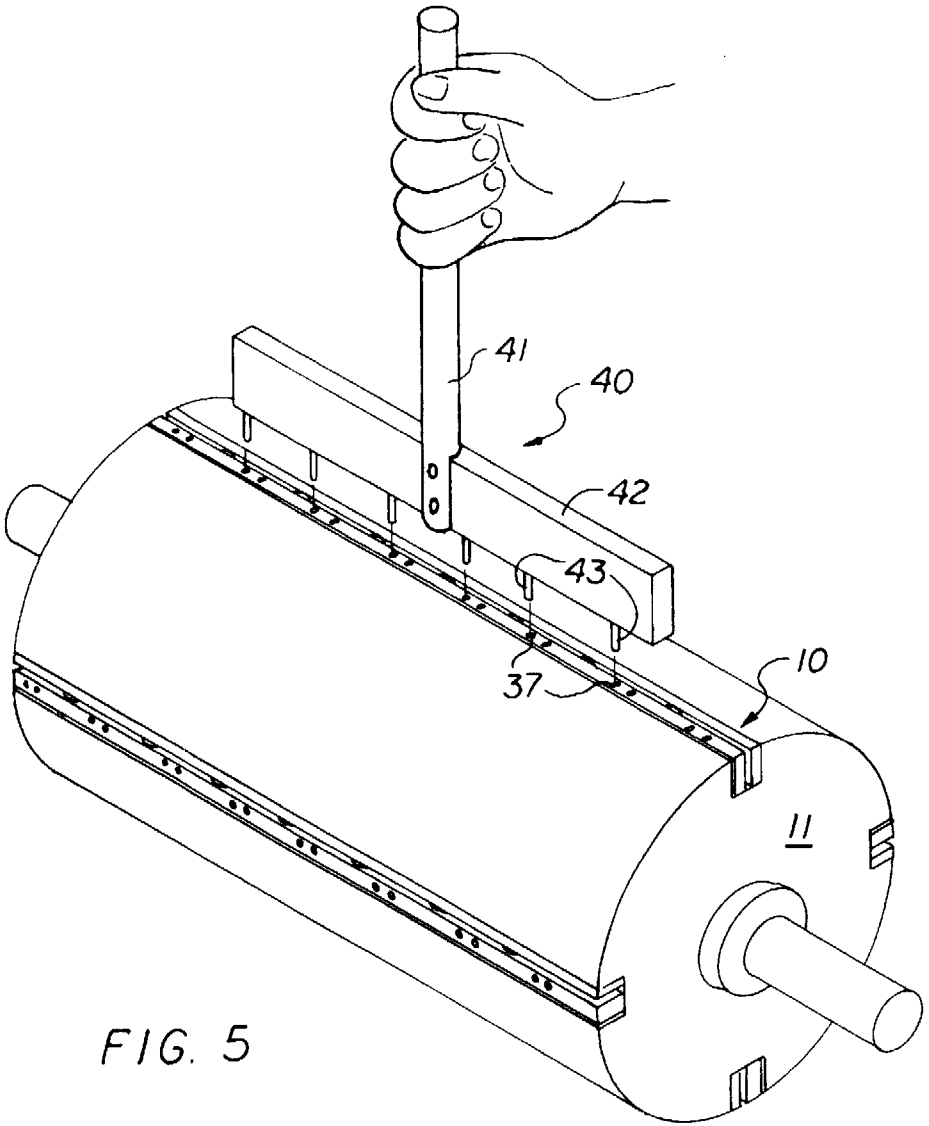
FIG. 5 is an environmental view of the blade clamping assembly and rotary cylinder of FIG. 1 wherein a blade is being removed from the rotary cylinder.

Once the blade clamping assembly is installed in the rotary cylinder groove, a perforating blade is then installed with the aid of a tool illustrated in FIG. 5. The tool 40 has a handle 41 with a leg 42 extending at right angles from the handle's end. A set of prongs 43 extend outwardly from the leg 42. The prongs 43 are spaced on the leg 42 to match with the holes 37 in the retainer bar 20. The prongs of the tool are initially forced down into the retainer bar holes. The tool 40, with its handle serving as a lever, then is caused to exert a compressing force on the compressive spacers of the blade clamping assembly by rocking the retainer bar back towards the backing plate of the assembly. This creates an opening between the retainer bar and a side wall of the groove sufficiently wide that the perforating blade can be slipped into the groove such that its teeth extend from the groove the desired approximate distance. Any height adjustment of the blade is now made in the manner discussed above.

Replacement of a perforating blade in the blade clamping assembly is readily made. The tool 40 is again used to compress the spacers sufficiently to free the old blade and remove it. A new blade is installed at the same time.

It should be apparent a new perforating blade can quickly replace an old blade in the rotary cylinder. The blade clamping assembly does not have to be removed from the cylinder's groove to effect the blade change. A blade can be changed in less than 20 seconds with ordinary skill. Secondary benefits that come from use of the blade clamping assembles include a longer blade life, a more quiet running operation, and greater operator safety.

The invention has been described in detail with particular reference to the drawings. Various modifications and changes of an obvious nature can be made. For example, added side bolt clamp assemblies can be used to further enhance the retention of the blade clamping assembly in the rotary cylinder during high speed use. A flat back-up surface can be used with the rotary cylinder. Still other changes are feasible without detracting from the benefits of the invention. All such modifications and changes are considered within the scope of the appended claims.

I claim:

1. A blade clamping assembly to releasably retain an elongated flat blade in a transverse peripheral groove having a bottom wall and two sidewalls of a rotary cylinder in a manner whereby the blade is capable of being changed quickly, said blade clamping assembly comprising:

(a) an elongated retainer bar dimensioned to fit within the groove on the rotary cylinder and having an inside face and an outside face, said retainer bar having a substantially rectangular shape when viewed in a cross section taken normal to the direction of elongation of said retainer bar, said outside face receiving said flat blade therealong and being proximate one of the sidewalls of the transverse peripheral groove when said blade clamping assembly is placed in the groove to press the blade on the sidewall, said inside face being parallel to said outside face and to the elongated flat blade received along the outside face, said retainer bar having (i) at least one positioning cavity in the inside face and (ii) height adjusting means for adjusting the position of the retainer bar and blade in the groove;

(b) an elongated backing plate for the retainer bar and having an inside face and an outside face, said inside face of said backing plate lying parallel to said inside and outside faces of said retainer bar and facing said inside face of said retainer bar, said outside face of said backing plate being proximate the other of the sidewalls of the transverse peripheral groove when said blade clamping assembly is placed in the groove, said backing plate having at least one positioning cavity in the inside face thereof, each of which is in alignment with the respective positioning cavity in the retainer bar; and (c) a compressive spacer disposed in both the positioning cavity of the retainer bar and the corresponding positioning cavity of the backing plate for each aligned positioning cavity to provide a space between said inside faces of said retainer bar and said backing plate and to exert a separating force on said inside faces of said retainer bar and said backing plate that is applied solely orthogonally to said inside faces to laterally force apart the elongated retainer bar and the elongated backing plate so as to define the space therebetween and, when the blade clamping assembly is positioned in the transverse peripheral groove of the rotary cylinder, to create a secure friction-fit of the blade against a sidewall of the transverse peripheral groove, and further each said compressive spacer is made of a resilient material for compressing together sufficiently to allow a removal of the blade from the groove and an insertion of another blade into the groove.

2. The blade clamping assembly of claim 1 wherein the elongated retainer bar further has a support ledge extending from a lower edge of the bar's outside face to provide a surface for the blade to rest.

3. The blade clamping assembly of claim 1 wherein the elongated retainer bar and the elongated backing plate each have a set of said positioning cavities which are substantially uniformly spaced along their respective lengths.

4. The blade clamping assembly of claim 3 wherein each said set comprises from three to twenty-five of said positioning cavities in the elongated retainer bar and the elongated backing plate, respectively.

5. The blade clamping assembly of claim 4 wherein each said positioning cavity in the elongated retainer bar and in the elongated backing plate is cylindrical-shaped.

6. The blade clamping assembly of claim 5 wherein each compressive spacer is cylindrical-shaped with a hole extending axially therethrough.

7. The blade clamping assembly of claim 6 wherein said resilient material for each compressive spacer comprises polyurethane.

8. The blade clamping assembly of claim 1 wherein the elongated retainer bar further has a set of substantially uniformly spaced threaded holes extending from a top face of the bar to a bottom face of the bar and further wherein the height adjusting means is a set of (i) set screws, one disposed in each of the threaded holes in the retainer bar, (ii) a lock cap in each of the threaded holes to lock the set screw in place and (iii) a resilient peg in each of the threaded holes to extend out through the threaded hole and into contact with a bottom wall of the rotary cylinder groove.

9. The blade clamping assembly of claim 8 wherein each resilient peg is made from an acetal resin.

10. The blade clamping assembly of claim 1 wherein said retainer bar has a plurality of spaced holes extending into said retainer bar from the top face of the bar for receiving the prongs of a retainer tool by which said at least one compressive spacer may be compressed sufficiently to allow removal of the blade from the groove and the insertion of another blade into the groove.

11. A blade clamping assembly to releasably retain an elongated, flat blade in a transverse peripheral groove of a rotary cylinder during a perforating, cutting, or scoring treatment of a continuous web, and in a manner whereby the blade is capable of being changed quickly, said blade clamping assembly comprising:

(a) an elongated retainer bar dimensioned to fit within the groove on the rotary cylinder and having an inside face and an opposed outside face with a support ledge extending from a lower edge of said outside face to provide a surface for the blade to rest, said inside face being parallel to said outside face and to said blade when said blade is received on said support ledge, said retainer bar being substantially rectangular shaped when viewed in a cross section taken normal to the direction of elongation of said retainer bar, said retainer bar further having (i) a set of substantially uniformly spaced positioning cavities in the inside face and (ii) height adjusting means for adjusting the position of the retainer bar and blade in the groove;

(b) an elongated backing plate having an inside face and an outside face, said inside face of said backing plate lying parallel to said inside face and said outside face of said retainer bar, said inside face of said backing plate facing said inside face of said retainer bar, said backing plate further having a set of substantially uniformly spaced positioning cavities in the inside face thereof, each in alignment with the respective one of the positioning cavities in the retainer bar; and (c) a set of compressive spacers with each said compressive spacer disposed in both the positioning cavity of the retainer bar and the corresponding aligned positioning cavity of the backing plate to provide a space between said inside faces and to exert a separating force on said inside faces of said retainer bar and said backing plate that is applied solely orthogonally to said inside faces for each of the aligned positioning cavities to laterally force apart the retainer bar and the backing plate so as to define the space therebetween to create a secure friction-fit of the blade in the groove of the cylinder and further each said compressive spacer is made of a resilient material for being compressed together sufficiently to allow a removal of the blade from the groove and an insertion of another blade into the groove.

12. The blade clamping assembly of claim 11 wherein each said set comprises from three to twenty-five of said positioning cavities in the elongated retainer bar and the elongated backing plate, respectively.

13. The blade clamping assembly of claim 12 wherein each said set comprises from three to ten of said positioning cavities in the elongated retainer bar and the elongated backing plate, respectively.

14. The blade clamping assembly of claim 13 wherein each positioning cavity in the elongated retainer bar and in the elongated backing plate is cylindrical-shaped and wherein each compressive spacer is cylindrical-shaped with a hole extending axially therethrough.

15. The blade clamping assembly of claim 14 wherein said resilient material for each compressive spacer comprises polyurethane.

16. The blade clamping assembly of claim 11 wherein the elongated retainer bar further has a set of substantially uniformly spaced threaded holes extending from a top face of the bar to a bottom face of the bar and further wherein the height adjusting means is a set screw assembly disposed in each of the threaded holes in the retainer bar, each said set screw assembly having a set screw threaded into one of the threaded holes, a lock cap for locking the set screw in place and a resilient peg for extending out through the threaded hole and into contact with a bottom wall of the rotary cylinder groove.

17. The blade clamping assembly of claim 16 wherein each resilient peg is made from an acetal resin.

18. The blade clamping assembly of claim 11 wherein said retainer bar has a plurality of spaced holes extending into said retainer bar from the top face of the bar for receiving the prongs of a retainer tool by which said compressive spacers may be compressed sufficiently to allow removal of the blade from the groove and the insertion of another blade into the groove.

19. A blade clamping assembly to releasably retain a blade in a transverse peripheral groove of a rotary cylinder during a perforating, cutting, or scoring treatment of a continuous web, and in a manner whereby the blade is capable of being changed quickly, said blade clamping assembly comprising:

(a) an elongated retainer bar dimensioned to fit within the groove on the rotary cylinder and having an inside face, an outside face, a top face and a bottom face with a support ledge extending from a lower edge of said outside face to provide a surface for the blade to rest, said retainer bar having a substantially rectangular shape when viewed in a cross section taken normal to the direction of elongation of said retainer bar and further having (i) a set of substantially uniformly spaced positioning cavities in the inside face, (ii) a set of substantially uniformly spaced threaded holes extending from the top face to the bottom face and (iii) height adjusting means for adjusting the position of the retainer bar and blade in the groove, said height adjusting means being a set of set screws wherein one of said set screws is disposed in each of the threaded holes, a lock cap for each set screw for locking said set screw in place and a resilient peg for each set screw and extending out through the threaded hole for contacting the bottom wall of the rotary cylinder groove;

(b) an elongated backing plate having a rectangular shape when viewed in a cross section taken normal to the direction of elongation of said backing plate with a width and height approximate that of the elongated retainer bar and further having a set of substantially uniformly spaced positioning cavities in a face thereof, each of which is in alignment with the respective one of the positioning cavities in the retainer bar; and (c) a set of compressive spacers with each said compressive spacer disposed in both the positioning cavity of the retainer bar and the corresponding positioning cavity of the backing plate for each of the aligned positioning cavities and further defining a space between the retainer bar and the backing plate wherein each said compressive spacer is made of a resilient material for forcing apart said retainer bar and backing plate sufficiently to create a secure friction-fit of the blade in the groove of the cylinder and further for compressing together sufficiently to allow a removal of the blade from the groove and an insertion of another blade into the groove.

20. The blade clamping assembly of claim 19 wherein said resilient material for each compressive spacer comprises polyurethane.

21. The blade clamping assembly of claim 19 wherein said retainer bar has a second set of spaced holes extending into said retainer bar from the top face of the bar for receiving the prongs of a retainer tool by which said compressive spacers may be compressed sufficiently to allow removal of the blade from the groove and the insertion of another blade into the groove.

* * * * *